US006005472A

United States Patent [19]

Mitsuhashi

[11] Patent Number: 6,005,472

[45] Date of Patent: Dec. 21, 1999

[54] INNER RESISTOR FOR CATHODE-RAY TUBE

[75] Inventor: Shinobu Mitsuhashi, Kanagawa, Japan

[73] Assignee: Sony Corporation, Japan

[21] Appl. No.: 09/237,834

[22] Filed: Jan. 27, 1999

[30] Foreign Application Priority Data

Jan. 30, 1998 [JP] Japan ..... 10-018717

[51] Int. Cl.[6] ..... H01C 1/06

[52] U.S. Cl. ..... 338/64; 338/308

[58] Field of Search ..... 338/64, 307, 308, 338/309, 320, 295; 313/414, 417, 449

[56] References Cited

U.S. PATENT DOCUMENTS

| | | | |
|---|---|---|---|
| 4,306,217 | 12/1981 | Solow | 338/275 |
| 4,349,767 | 9/1982 | Muramoto et al. | 313/449 |
| 4,760,370 | 7/1988 | Nikaido et al. | 338/308 |

*Primary Examiner*—Lincoln Donovan
*Assistant Examiner*—Richard K. Lee
*Attorney, Agent, or Firm*—Rader, Fishman & Grauer; Ronald P. Kananen

[57] ABSTRACT

In a CRT inner resistor, it is intended to prevent the potential of an electrode from being varied owing to leak current that is caused by electric field concentration on the circumferential portion of the electrode because an insulating substrate is charged with stray electrons. An insulating substrate, and electrodes and a resistive body that are connected to each other are provided. An insulating glass layer is provided on the insulating substrate so as to cover the resistive body. Shield members made of insulating glass are provided along the circumferences of the respective electrodes so as to cover the peripheries of the respective electrodes and the portions outside the peripheries of the respective electrodes. The shield members prevent charging of the portions of the insulating substrate outside the peripheries of the respective electrodes and in their vicinities, prevent electric field concentration in the vicinity of the peripheries of the respective electrodes, and inhibit the occurrence of leak current.

6 Claims, 4 Drawing Sheets

INNER RESISTOR FOR CATHODE-RAY TUBE

BACKGROUND OF THE INVENTION

The present invention relates to a resistor that is incorporated in a cathode-ray tube (hereinafter referred to as a CRT inner resistor or an inner resistor) and, more particularly, to a CRT inner resistor capable of preventing leak current.

A CRT inner resistor for supplying a prescribed focus voltage and convergence correction voltage is provided in the electron gun portion of a CRT. As shown in FIG. 1A, an inner resistor 6 as mentioned above has an insulating substrate 11, and electrodes 12*a*–12*c* and a resistive body 13 that are provided on the insulating substrate 11. The electrodes 12*a*–12*c* are provided in series at both ends and a prescribed intermediate position of the resistive body 13. As shown in FIG. 1B, an insulating glass layer 14 is provided on the insulating substrate 11 so as to cover the resistive body 13. The insulating glass layer 14 is to protect the resistive body 13 from the high-voltage environment inside a CRT.

With the inner resistor 6, a prescribed intermediate voltage can be obtained from the electrode 12*c* that is provided at the prescribed intermediate position of the resistive body 13 by using, as a ground side, the electrode 12*a* that is connected to one end of the resistive body 13 and supplying a high voltage to the electrode 12*b* that is connected to the other end of the resistive body 13.

However, the inner resistor having the above structure has the following problems.

In the inside space of a CRT where the inner resistor is disposed, scanning with electron beams is performed by supplying a high voltage of about 20–30 kV. Therefore, stray electrons slightly exist in the vicinity of the inner resistor and cause charging of the surface of the insulating substrate.

However, as shown in FIGS. 2A (enlarged view of the main part) and 2B (sectional view of the main part), the peripheral portions of the respective electrodes 12*a*–12*c* (represented by the electrode 12*c* in those figures) of the inner resistor 6 have what is called a "knife edge" shape in which the film thickness gradually decreases from the central side to the outside because the electrodes 12*a*–12*c* are formed on the insulating substrate 11 by screen printing. Therefore, as shown in FIG. 2C, which is an enlarged view of part B of FIG. 2B, an electric field is concentrated in the vicinity of the circumference of the electrode 12*c* owing to slight charging of the surface of the insulating substrate 11 and the electric field strength is increased there. Electrons are emitted from the circumferential portion of the electrode 12*c* by field emission and leak current occurs. As a result, the potential of the electrode 12*c* is varied.

This is a factor of causing problems of mis-focusing due to a variation in focus voltage and a mis-convergence due to a variation in convergence correction voltage.

OBJECT AND SUMMARY OF THE INVENTION

The invention provides an inner resistor for a CRT, comprising an insulating substrate; an electrode provided on the insulating substrate; a resistive body provided on the insulating substrate; and a shield member provided along a circumference of the electrode so as to cover a periphery of the electrode and a portion outside the periphery of the electrode.

In the inner resistor having the above structure, the region including the periphery of the electrode and the portion of the insulating substrate outside the periphery of the electrode are covered with the shield member from above. Therefore, the portion of the insulating substrate in the vicinity of the periphery of the electrode is prevented from being charged because the shield member serves as a barrier to stray electrons existing inside a CRT. Since the interval between the charged portion of the insulating substrate and the circumference of the electrode is increased, the degree of electric field concentration in the vicinity of the circumference of the electrode is reduced. Therefore, the electric field strength in the vicinity of the circumference of the electrode is lowered and hence electron emission from the circumferential portion of the electrode due to field emission is prevented, whereby a focus voltage or a convergence correction voltage that is supplied via the inner resistor can be stabilized.

DETAILED DESCRIPTION OF THE PREFERRED EMBODIMENTS

CRT inner resistors (hereinafter referred to as inner resistors) according to several embodiments of the present invention will be hereinafter described with reference to the accompanying drawings. The following description will be made in such a manner that the components that are the same as the related art components shown in FIGS. 1A–1B and 2A–2C are given the same reference symbols as in those figures.

Embodiment 1

Figure 1A:
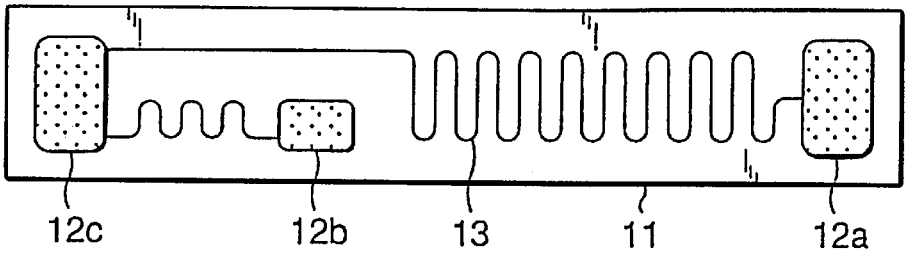
FIG. 1A PRIOR ART
FIG. 1A and 1B are plan views showing the structure of a conventional inner resistor.
Figure 1B:
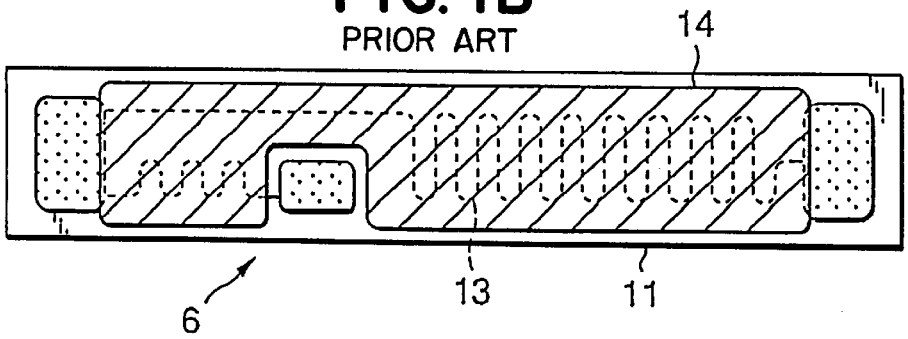
FIG. 1B PRIOR ART
Figure 2A:
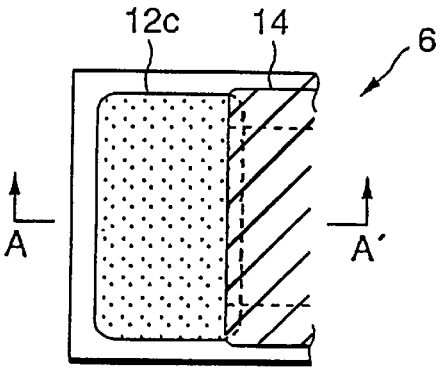
FIG. 2A PRIOR ART
FIGS. 2A–2C are views illustrating problems of the conventional inner resistor.
Figure 2B:
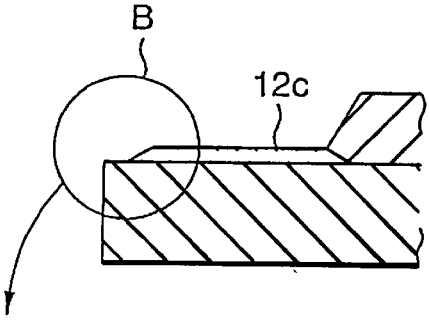
FIG. 2B PRIOR ART
Figure 2C:
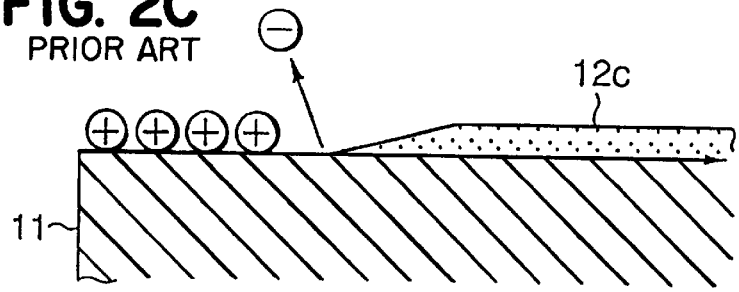
FIG. 2C PRIOR ART
Figure 3A:
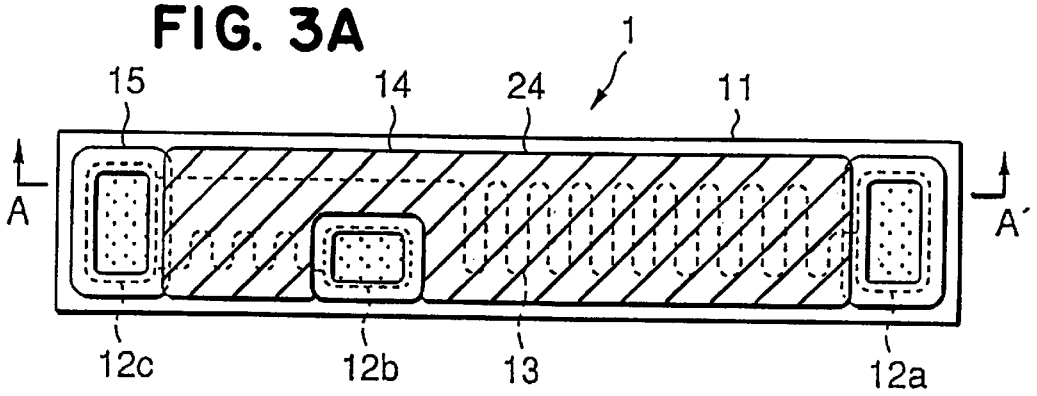
FIG. 3A is a plan view showing the structure of an inner resistor according to a first embodiment of the present invention.
Figure 3B:
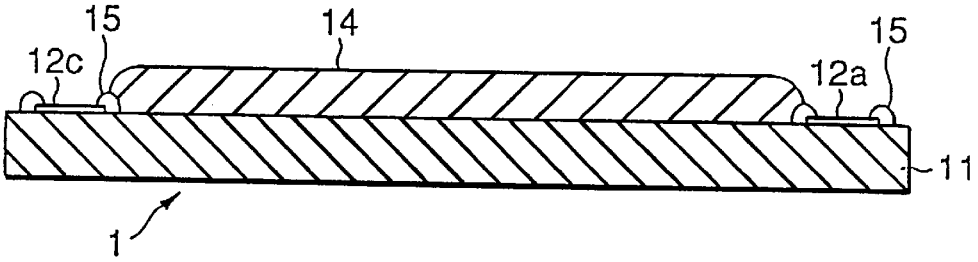
FIG. 3B is a sectional view taken along line 3B—3B in FIG. 3A.

FIG. 3A is a plan view of an inner resistor according to a first embodiment of the invention. FIG. 3B is a sectional view taken along line 3B—3B in FIG. 3A.

An inner resistor 1 shown in FIGS. 3A and 3B has an insulating substrate 11, and electrodes 12*a*–12*c* and a resistive body 13 that are provided on the insulating substrate 11. Shield members 15 are provided on the insulating substrate 11 along the circumferences of the respective electrodes 12a-12c, and an insulating glass layer 14 is also provided on the insulating substrate 11 so as to cover the resistive body 13.

The insulating substrate 11 is made of an insulative material such as alumina and has a plate-like shape.

The electrodes 12*a*–12*c* are provided, for example, at both ends of the resistive body 13 and a single or a plurality of prescribed intermediate positions of the resistive body 13, and are connected to each other in series by the resistive body 13. FIGS. 3A and 3B show a case that one electrode 12*c* is provided at an intermediate position of the resistive body 13. The electrode 12*a* that is connected to one end of the resistive body 13 is used as a ground side, the electrode 12*b* that is connected to the other end of the resistive body 13 is used as a high-voltage supply side, and the electrode 12*c* that is provided at the prescribed intermediate position is used as a pickup electrode. The electrodes 12*a*–12*c* are made of a metal electrode thick-film material having gold (Au) as the main component, a the thick-film resistor material having a relatively low resistivity value, or the like.

The resistive body 13 is made of a common thick-film resistive body material composed, for example, of ruthenium oxide and low-melting-point glass, and is provided on the insulating substrate 11 so as to connect the electrodes 12*a* and 12*c* and the electrodes 12*c* and 12*b*.

The shield members 15 are provided along the circumferences of the respective electrodes 12*a*–12*c* so as to cover the peripheries of the respective electrodes 12*a*–12*c* and the portions of the insulating substrate 11 outside those peripheries. The shield members 15 are made of an insulative material such as insulating glass.

The insulating glass layer 14 is provided on the insulating substrate 11 so as to cover the resistive body 13. The portions of the peripheral portion of the insulating glass layer 14 coextend with the peripheral portions of the shield members 15, respectively. The insulating glass layer 14 is to protect the resistive body 13 from the high-voltage environment inside a CRT, and has such a film thickness (e.g., 500 μm) as to secure sufficient insulation performance.

Figure 4A:
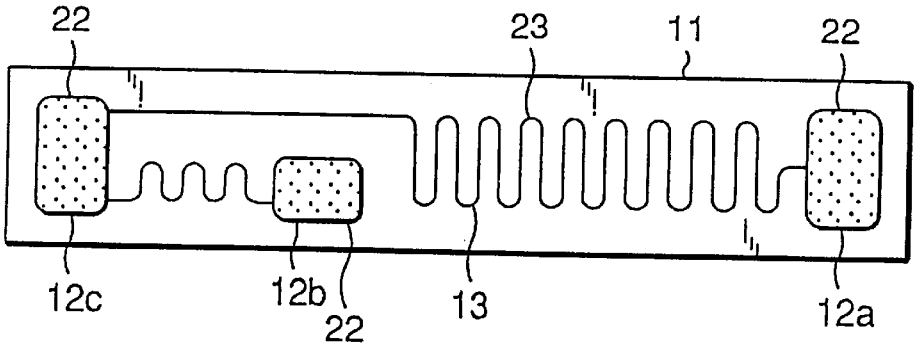
FIGS. 4A and 4B schematically show a manufacturing process for forming the inner resistor of the first embodiment.
Figure 4B:
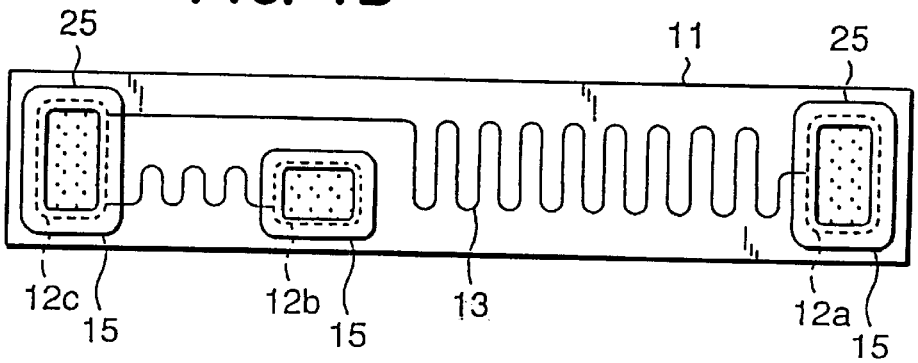

FIGS. 4A and 4B show a manufacturing process for forming the inner resistor 1. To form the inner resistor 1, first, a paste-like electrode material 22 is applied (printed) to an insulating substrate 11 by screen printing and then dried, as shown in FIG. 4A. Then, a paste-like resistive body material 23 is applied (printed) to the insulating substrate 11 by screen printing and then dried. Thereafter, the dried electrode material 22 and resistive body material 23 are fired at a predetermined temperature. As a result, electrodes 12*a*–12*c* made of the electrode material 22 and a resistive body 13 made of the resistive body material 23 are formed on the insulating substrate 11. The peripheral portions of the electrodes 12*a*–12*c* and the resistive body 13 have a "knife edge" shape.

Then, as shown in FIG. 4B, a paste-like insulating glass material 25 is applied (printed) along the circumferences of the respective electrodes 12*a*–12*c* by screen printing so as to cover the peripheries of the respective electrodes 12*a*–12*c* and the portions of the insulating substrate 11 outside those peripheries. The insulating glass material 25 is then dried. The application film thickness of the insulating glass material 25 is set in accordance with the patterns of the respective electrodes 12*a*–12*c* so as to be applied (printed) with high accuracy along their circumferences.

Then, as shown in FIGS. 3A and 3B, a paste-like insulating glass material 24 is applied (printed) to the insulating substrate 11 by screen printing so as to cover the resistive body 13 and then dried. The application film thickness of the insulating glass material 24 is determined in accordance with a film thickness setting value of the insulating glass layer 14 to be formed of the insulating glass material 24.

After the above steps, the insulating glass materials 24 and 25 are fired at a predetermined temperature, whereby the insulating glass layer 14 made of the insulating glass material 24 and the shield members 15 made of the insulating glass material 25 are formed.

The insulating glass material 24 and the insulating glass material 25 may be the same material.

Figure 5:
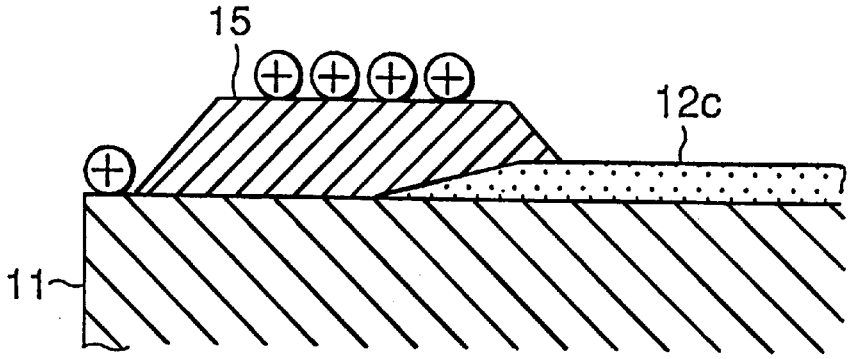
FIG. 5 illustrates a discharge preventing effect in the inner resistor of the first embodiment.

In the inner resistor 1 formed in the above manner, the regions including the peripheries of the respective electrodes 12*a*–12*c* and the portions of the insulating substrate 11 outside those peripheries are covered with the shield members 15 from above. Therefore, as shown in FIG. 5 (sectional view of the main part), the portions of the insulating substrate 11 in the vicinity of the peripheries of the respective electrodes 12*a*–12*c* (represented by the electrode 12*c* in FIG. 5) are prevented from being charged because the shieldmembers 15 serve as barriers to stray electrons in the inside space of a CRT where the inner resistor 1 is disposed. Since the interval between the charged portion of the insulating substrate 11 and the circumference of the electrode 12*c* is increased, the degree of electric field concentration in the vicinity of the circumference of the electrode 12*c* is reduced. Further, electron emission from the circumferential portion of the electrode 12*c* due to the electric field concentration is prevented because the periphery of the electrode 12*c* is covered with the shield member 15 that is made of the insulating glass.

As a result, leak current from the electrode 12*c* can be prevented in the above inner resistor 1. In conventional inner resistors that are not provided with shield members, the rate of occurrence of leak current from the electrodes was several percent. In contrast, in the inner resistor 1 of the first embodiment, the rate of occurrence of leak current was reduced to about 0.01%.

It is understood from the above description that it becomes possible to keep the potential value of the electrode 12*c* stable and hence to supply a stable focus voltage or convergence correction voltage from the electrode 12*c* that is disposed at the intermediate position of the resistive body 13 in the inner resistor 1.

As described above in connection with FIG. 4B, by setting the film thickness of the shield members 15 in accordance of the shapes of the respective electrodes 12*a*–12*c*, it becomes possible to form the shield members 15 with high accuracy along the circumferences of the respective electrodes 12*a*–12*c* having smaller areas.

Embodiment 2

Figure 6:
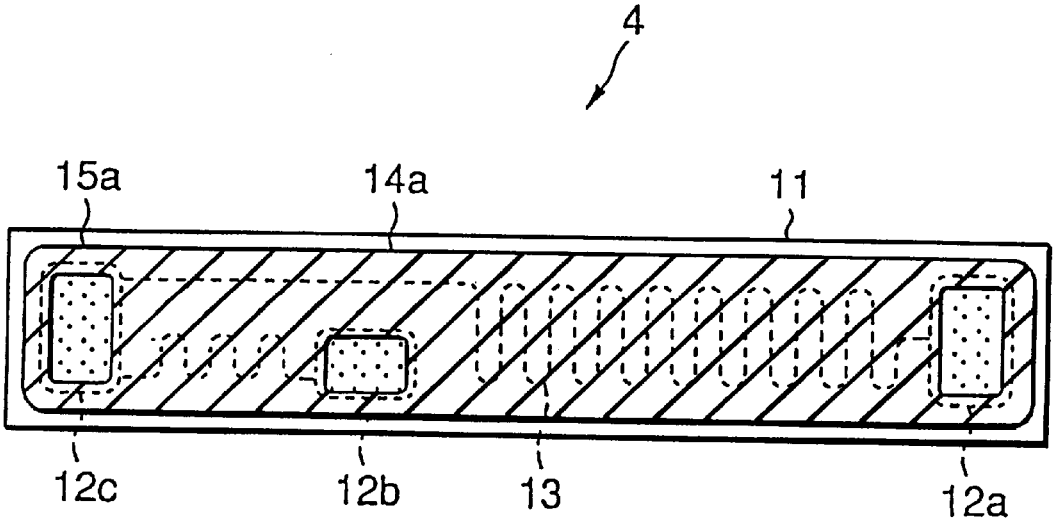
FIG. 6 is a plan view showing the structure of an inner resistor according to a second embodiment of the invention.

FIG. 6 is a plan view of an inner resistor according to a second embodiment of the invention.

An inner resistor 4 of the second embodiment shown in FIG. 6 is different from the inner resistor 1 of the first embodiment that has been described above in connection with FIGS. 3A and 3B in the structures of shield members 15*a* and an insulating glass layer 14*a*, and the structures of other parts, that is, an insulating substrate 11, electrodes 12*a*–12*c*, and a resistive body 13 are the same as in the inner resistor 1 of the first embodiment.

That is, the shield members 15*a* of the inner resistor 4 are integral with the insulating glass layer 14*a*. Therefore, the peripheries of the respective electrodes 12*a*–12*c* and the portions outside those peripheries are covered with the shield members 15*a* as extensions of the peripheral portions of the insulating glass layer 14*a*.

Also in the inner resistor 4 having the above structure, charging of the portions of the insulating substrate 11 outside the peripheries of the respective electrodes 12*a*–12*c* and their vicinities can be prevented as in the case of the inner resistor 1 of the first embodiment, because the regions including the peripheries of the respective electrodes 12*a*–12*c* and the portions of the insulating substrate 11 outside those peripheries are covered, from above, with the shield members 15*a* that are parts of the insulating glass layer 14*a*. Therefore, leak current from the circumferential portions of the respective electrodes 12*a*–12*c* can be inhibited as in the case of the inner resistor 1 of the first embodiment, whereby the same advantages as in the inner resistor 1 of the first embodiment can be obtained.

Also in the inner resistor 4 having the above structure, the rate of occurrence of leak current was reduced to the same extent as the inner resistor 1 of the first embodiment.

Since the insulating glass layer 14*a* and the shield member 15*a* are integral with each other, the inner resistor 4 can be obtained without adding a manufacturing step of forming the shield members 15*a*.

Embodiment 3

Figure 7A:
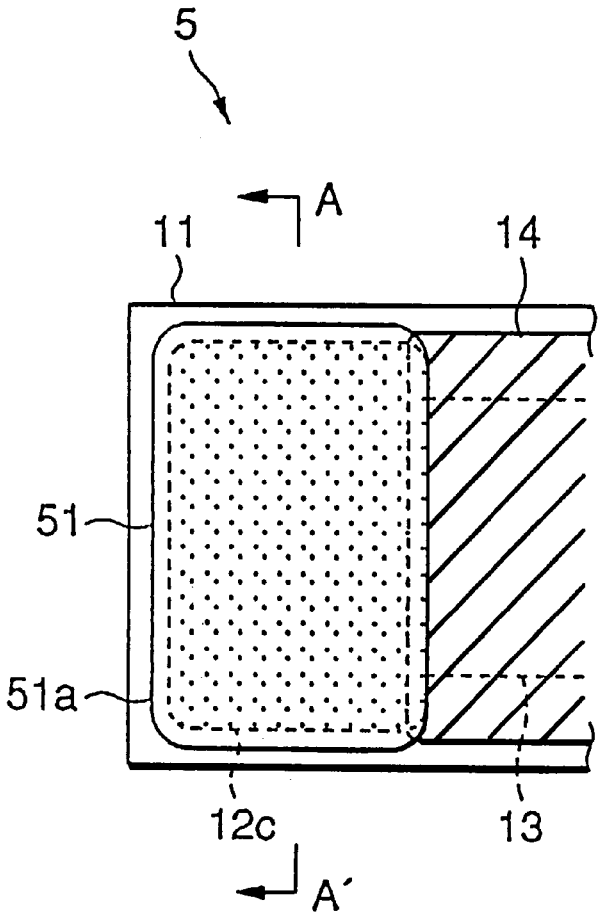
FIG. 7A is a plan view showing the structure of the main part of an inner resistor according to a third embodiment of the invention.
Figure 7B:
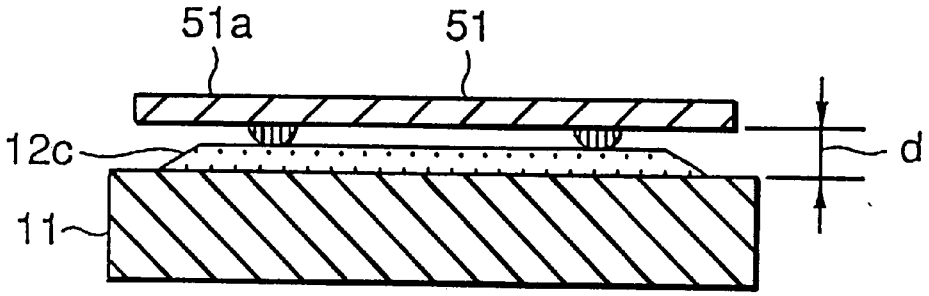
FIG. 7B is a sectional view taken along line 7B—7B in FIG. 7A.

FIG. 7A is a plan view of the main part of an inner resistor according to a third embodiment of the invention. FIG. 7B is a sectional view taken along line 7B—7B in FIG. 7A.

An inner resistor 5 of the third embodiment shown in FIGS. 7A and 7B is different from the inner resistor 1 of the first embodiment that has been described above in connection with FIGS. 3A and 3B in the structure of shield members 51*a*, and the structures of other parts, that is, an insulating substrate 11, electrodes 12*a*–12*c* (represented by the electrode 12*c* in FIGS. 7A and 7B), a resistive body 13, and an insulating glass layer 14 are the same as in the inner resistor 1 of the first embodiment.

That is, the shield member 51*a* of the inner resistor 5 is a conductive plate that is provided over the periphery of the electrode 12*c* and the portion outside the periphery. For example, the shield member 51*a* is an extension of the peripheral portion of a terminal metal part 51 to be connected to the electrode 12*c*. The terminal metal part 51 is to supply or pickup a voltage to or from the electrode 12*c*. In this case, to prevent electron emission from the circumference of the terminal metal part 51, an interval d is kept between the circumference of the terminal metal part 51 and the insulating substrate 11.

In the inner resistor 5 having the above structure, the region including the periphery of the electrode 12*c* and the portion of the insulating substrate 11 outside that periphery are covered, from above, with the shield member 51*a* that is the extension of the peripheral portion of the terminal metal part 51. Therefore, the shield member 51*a* has an electric field shield effect and the above region is shielded by the shield member 51*a*. Therefore, charging of the portion of the insulating substrate 11 in the vicinity of the circumference of the electrode 12*c* is prevented from being charged because the shield member 51*a* serves as a barrier to stray electrons in the inside space of a CRT where the inner resistor 5 is disposed.

It is understood from the above description that leak current from the circumferential portion of the electrode 12*c* can be inhibited as in the case of the inner resistor 1 of the first embodiment, whereby the same advantages as in the inner resistor 1 of the first embodiment can be obtained.

Also in the inner resistor 5 having the above structure, the rate of occurrence of leak current was reduced to the same extent as the inner resistor 1 of the first embodiment.

Since the shield member 51*a* and the terminal metal part 51 are integral with each other, the inner resistor 5 can be obtained without adding a manufacturing step of forming the shield members 51*a*.

The above embodiments are directed to the case where the shield members are provided along the circumferences of all the electrodes formed on the insulating substrate. However, the shield member may be provided for only an electrode having a problem of a potential variation due to field emission.

What is claimed is:

1. An inner resistor for a CRT, comprising:

an insulating substrate;

an electrode provided on the insulating substrate;

a resistive body provided on the insulating substrate, the electrode and the resistive body being connected to each other; and a shield member provided along the circumference of the electrode so as to cover the periphery of the electrode and a portion outside the periphery of the electrode.

2. The inner resistor according to claim 1, wherein the resistive body is covered with an insulating glass layer.

3. The inner resistor according to claim 2, wherein the shield member and the insulating glass layer are integral with each other.

4. The inner resistor according to claim 1, wherein the shield member is an extension of a peripheral portion of a terminal metal part.

5. The inner resistor according to claim 2, wherein the shield member is an extension of a peripheral portion of a terminal metal part.

6. The inner resistor according to claim 3, wherein the shield member is an extension of a peripheral portion of a terminal metal part.

* * * * *